US005705919A

United States Patent [19]

Wilcox

[11] Patent Number: 5,705,919

[45] Date of Patent: Jan. 6, 1998

[54] LOW DROP-OUT SWITCHING REGULATOR ARCHITECTURE

[75] Inventor: Milton E. Wilcox, Saratoga, Calif.

[73] Assignee: Linear Technology Corporation, Milpitas, Calif.

[21] Appl. No.: 723,575

[22] Filed: Sep. 30, 1996

[51] Int. Cl.[6] ..... G05F 1/56

[52] U.S. Cl. ..... 323/282; 323/268

[58] Field of Search ..... 323/268, 271–275, 323/282, 284–287

[56] References Cited

U.S. PATENT DOCUMENTS

| | | | |
|---|---|---|---|
| 4,881,023 | 11/1989 | Perusse et al. | 323/266 |
| 5,309,082 | 5/1994 | Payne | 323/270 |
| 5,359,278 | 10/1994 | Notohara et al. | 323/222 |
| 5,365,118 | 11/1994 | Wilcox | 327/109 |
| 5,481,178 | 1/1996 | Wilcox et al. | 323/287 |
| 5,563,501 | 10/1996 | Chan | 323/282 |

OTHER PUBLICATIONS

1992 Linear Databook Supplement, pp. 4–102 to 1–121, published by Linear Technology Corporation, Milpitas, CA in 1990.

1995 Linear Databook vol. IV, pp. 13–3 to 13–15, published by Linear Technology Corporation, Milpitas, CA in 1995.

GE Integrated Power Systems Application Note, AN–8829, pp. 1 to 5, published by Harris Semiconductor Corporation in Dec. 1995.

LT 1336 Data Sheet, pp. 1–16, published by Linear Technology Corporation, Milpitas, CA in 1996.

*Primary Examiner*—Matthew V. Nguyen

*Attorney, Agent, or Firm*—Fish & Neave; Douglas A. Cardwell

[57] ABSTRACT

Circuits and methods are provided for low drop-out operation of switching regulator circuits that include a switching transistor and an output circuit adapted to supply current at a regulated voltage to a load. The circuits and methods generate a limiting signal that allows the switching transistor to remain in a continuous conductive state for a predetermined number of oscillator cycles. The predetermined number of oscillator cycles is preferably set by a counter that initiates a signal that turns the switching transistor OFF.

28 Claims, 4 Drawing Sheets

LOW DROP-OUT SWITCHING REGULATOR ARCHITECTURE

BACKGROUND OF THE INVENTION

The present invention relates to switching regulator circuits. More particularly, the present invention relates to switching regulator architectures for providing low drop-out operation.

The purpose of a voltage regulator is to provide a substantially constant output voltage to a load from a voltage source which may be poorly-specified or fluctuating. Voltage regulator circuits require a minimum voltage differential between the input supply voltage and the regulated output voltage in order to function properly. This voltage differential is known as the dropout voltage of the regulator. For a step-down regulator, the dropout voltage limits the maximum regulated voltage which can be supplied to the load. Conversely, for a given output voltage, the dropout voltage determines the minimum supply voltage required to maintain regulation.

One potential deficiency in known voltage regulators is the tendency for such regulators to consume a larger percentage of the supplied power as the output voltage decreases. For example, a linear voltage regulator providing a 10 volt output with a 1 volt dropout results in a ten percent power loss, while an output of 2 volts (i.e., a output voltage) with the same 1 volt dropout results in a fifty percent power loss. However, there have been increasing requirements for voltage regulators to operate at lower and lower voltages (e.g., the voltage at which microprocessors are powered has continued to fall from 5 volts to below 3 volts). As microprocessor voltages continue to fall, their clock speeds and supply currents are increasing. Thus, low dropouts are required, for example, to efficiently supply modern microprocessor regulated voltage inputs.

A voltage regulator having a low dropout voltage is therefore capable of providing a regulated output voltage at a lower supply voltage than can a voltage regulator having a higher dropout voltage. A low dropout voltage regulator can also operate with greater efficiency, since the input/output voltage differential of the regulator, when multiplied by the output current, equals the power dissipated by the regulator in transferring power to the load. For at least these reasons, a voltage regulator circuit having a low dropout voltage has many useful applications, and can improve the performance and reduce the cost of other circuits in which the regulator circuit is used.

Generally, regulators can be classified into several categories: step-down or boost and linear or switching.

A step-down regulator is one in which the power transfer is from a higher voltage to a lower voltage. A boost regulator is one in which the power transfer is from a lower Voltage to a higher voltage.

A linear regulator employs a pass element (e.g., a power transistor) coupled in series with a load and controls the voltage drop across the pass element to regulate the voltage which appears at the load. In contrast, a switching regulator employs a switch including a switching element (e.g., a power transistor) coupled either in series or parallel with the load. The switching regulator controls the timing of the turning ON and turning OFF of the switching element (i.e., the duty cycle) to regulate the flow of power to the load. Typical switching regulators employ inductive energy storage elements to convert switched current pulses into a steady load current. Thus, power in a switching regulator is transmitted across the switch in discrete current pulses, whereas power in a linear regulator is transmitted across the pass element as a steady flow of current.

Switching regulators are generally more efficient than linear regulators (where efficiency is defined as the ratio of the power provided by the regulator to the power provided to the regulator). Because of this, switching regulators are often employed in battery-operated communication systems such as cellular telephones, cordless telephones, pagers, personal communicators, and wireless modems.

One significant component of operating loss in switching regulators is the power dissipated by the switching element, where power dissipation is a function of the voltage drop across the switching element and the current flowing through it. The amount of this voltage drop, and thus the efficiency of the circuit, can depend on the particular configuration of the switching regulator. Bootstrapped switch drives are commonly required when the voltage required to turn on the switch is higher than the input voltage of the regulator.

Drop-out for step-down switching regulators is the state at which the regulator input voltage has dropped to the point at which the regulator output voltage starts to go out of regulation. The drop-out voltage is the voltage difference between the input and output voltages of a voltage regulator when the output voltage drops out of regulation. For example, if a step-down regulator designed to produce a regulated 5V output voltage lost regulation at a 6V input voltage, it would have a 1V drop-out.

The required duty cycle (defined as the ratio of the ON time of a switch to the switch's switching period) for such switches is set by the input and output voltages. For ideal step-down switching regulators, it can be shown that the duty cycle is equal to the ratio of $V_{OUT}$ to $V_{IN}$. For ideal boost switching regulators, it can be shown that the duty cycle is equal to the ratio of $(V_{OUT}-V_{IN})$ to $V_{OUT}$.

Near drop-out in a step-down switching regulator, when the input voltage is not much larger than the output voltage, high duty cycles are required in order to maintain a regulated output voltage. Conventional step-down switching regulators require very short minimum OFF times or low operating frequencies to achieve the high duty cycles required for low drop-out while still maintaining adequate bootstrapped switch drives. Each of these requirements has associated disadvantages.

One disadvantage of using a short minimum OFF time is that the switch drivers have a finite delay due to the rise and fall times which limits their ability to respond to control signals less than a certain duration.

The use of low operating frequencies also has associated disadvantages. During normal operation, low operating frequency produces large inductor ripple currents unless a large inductor is used. Also, large capacitors are often required to operate the regulator at lower frequencies. The result is a larger, heavier and more expensive switching regulator. A low operating frequency also may cause audible noise or interference in lower frequency bands, such as the audio or intermediate frequency bands.

Boost switching regulators require corresponding short minimum ON times to achieve low drop-out. Thus, there is a need for a step-down/boost switching regulator having high/low duty cycles during low drop-out and which does not have the disadvantages of operating with short minimum OFF/ON times and at low operating frequencies.

SUMMARY OF THE INVENTION

It is an object of the present invention to provide step-down/boost switching regulators having high/low duty cycles during low drop-out.

It is a further object of the present invention to provide step-down/boost switching regulators having high/low duty cycles during low drop-out which do not operate with short minimum OFF/ON times.

It is also an object of the present invention to provide step-down/boost switching regulators having high/low duty cycles during low drop-out which do not operate at low frequencies under normal operating conditions.

It is yet another object of the present invention to provide step-down/boost switching regulators which maintain bootstrapped switch drives during low drop out.

The disadvantages and limitations of previous switching regulators are overcome by the present invention in which switching regulators are provided that efficiently operate at high frequency. The switching regulators of the present invention provide efficient operation by only reducing frequency to defined lower levels when low frequency is required to meet duty cycle requirements near drop-out. This is accomplished in a step-down/boost regulator circuit by allowing the supply switch to remain ON/OFF continuously for more than one cycle which allows higher/lower duty cycles. The higher/lower duty cycles lead to lower drop-out than if the supply switch were forced to turn OFF/ON every cycle. Additional control circuitry is provided to prevent the ON/OFF time from exceeding a predetermined limit to avoid audible noise or damage to switch components from excessive heating due to loss of bootstrapped gate drive.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The present invention includes an architecture for step-down/boost switching regulators that provides low drop-out operation without having to operate with short minimum OFF/ON times or at constant low operating frequencies to achieve high/low duty cycles.

Figure 1:
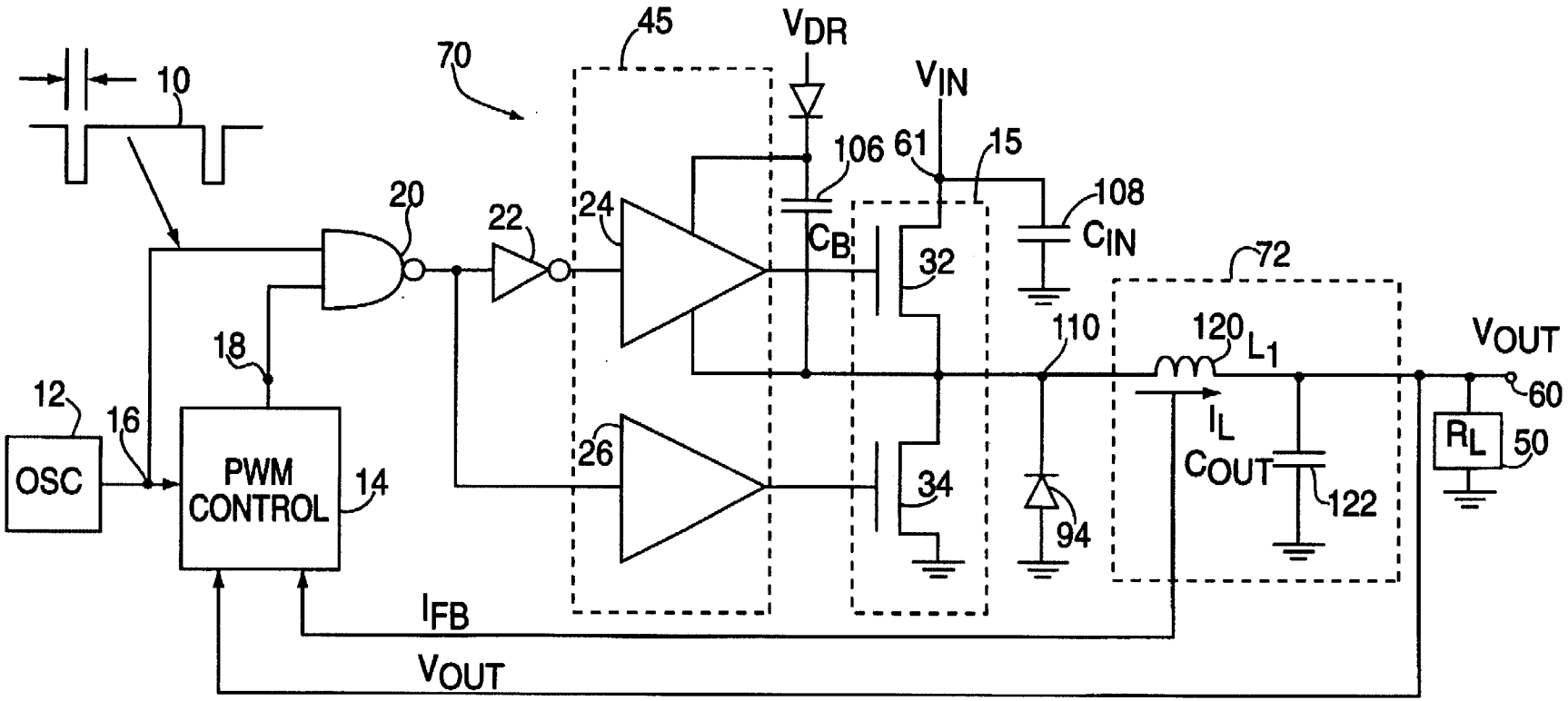
FIG. 1 PRIOR ART
FIG. 1 is a circuit diagram illustrating a known switching regulator.

FIG. 1 illustrates a known step-down switching regulator circuit 70 which provides a regulated DC output voltage $V_{OUT}$ at output terminal 60 (e.g., 5 volts) for driving load 50 which, for example, may be a portable or lap-top computer or other battery-operated system.

Driver circuit 45 comprises two drivers 24 and 26 which may include, for example, CMOS power inverter stages. Driver 24 includes circuitry for translating ground-referenced logic signals to gate-drive logic signals referenced to the switch node 110 voltage.

Driver circuit 45 is used to drive switch circuit 15, which is a push-pull switch including a pair of synchronously-switched switching transistors 32 and 34 stacked in series at switch node 110, between supply rail voltage $V_{IN}$ and ground. As used herein, the term "synchronously-switched" means that the two switching transistors are driven out of phase to supply current at a regulated voltage to load 50. Bootstrap capacitor 106 ($C_B$) is required to provide the necessary operating voltage for driver 24 because the voltage at the source of switching transistor 32 moves between ground and $V_{IN}$. Input capacitor 108 ($C_{IN}$) smooths variations in the supply rail voltage $V_{IN}$.

Switching transistors 32 and 34 are used to provide a switching supply of current to output circuit 72, which includes inductor 120 ($L_1$) and output capacitor 122 ($C_{OUT}$). When switching transistor 32 is OFF, switching transistor 34 is ON and conducts. Diode 94 conducts during the dead time (i.e., the time when both transistor 32 and transistor 34 are OFF). Output circuit 72 smooths the switching voltage of switch node 110, so that load 50 is provided a regulated voltage $V_{OUT}$. In order to supply inductor 120 current, switching transistors 32 and 34 are respectively driven by driver 24 and driver 26, which in turn are both controlled by a pulse-width modulator ("PWM") control circuit 14.

Driver 24 is controlled by the output of inverter 22, whose input is the output of NAND gate 20. The output of NAND gate 20 is produced based upon signal 16 from oscillator 12 and control signal 18 from the output of PWM control circuit 14. Driver 26 is controlled directly by the output signal of NAND gate 20. The PWM control circuit 14 uses a signal from oscillator 12, the output voltage $V_{OUT}$, and a feedback current $I_{FB}$, that is proportional to inductor current $I_L$, to generate control signal 18. During drop-out, control signal 18 is high, which causes switching transistor 32 to be ON and switching transistor 34 to be OFF whenever oscillator 12's output signal 16 is high.

One disadvantage of switching regulator 70 shown in FIG. 1 is that, even if control signal 18 is continuously high, oscillator pulse 10 (i.e., a portion of output signal 16) forces switching transistor 32 to turn OFF for a minimum period of time for each cycle of oscillator 12. This minimum OFF time must be very short for switching regulator circuit 70 to operate at the required switch duty cycle during low drop-out operation. However, if the minimum OFF time is too short, drivers 24 and 26 may not be able to respond and the switch node 110 may not swing low enough to recharge bootstrap capacitor 106. Forcing drivers 24 and 26 to adequately respond to such short signals, on the other hand, would result in an increase in peak currents and current slew rates that would undesirably increase electromagnetic interference.

Another disadvantage of switching regulator circuit 70 of FIG. 1 is that, if the minimum OFF time of switching transistor 32 is kept at a magnitude compatible with drivers 24 and 26, then the duty cycle can only be increased by reducing the operating frequency. As previously discussed, however, such low operating frequencies result in larger, heavier, and more expensive switching regulators.

Figure 2:
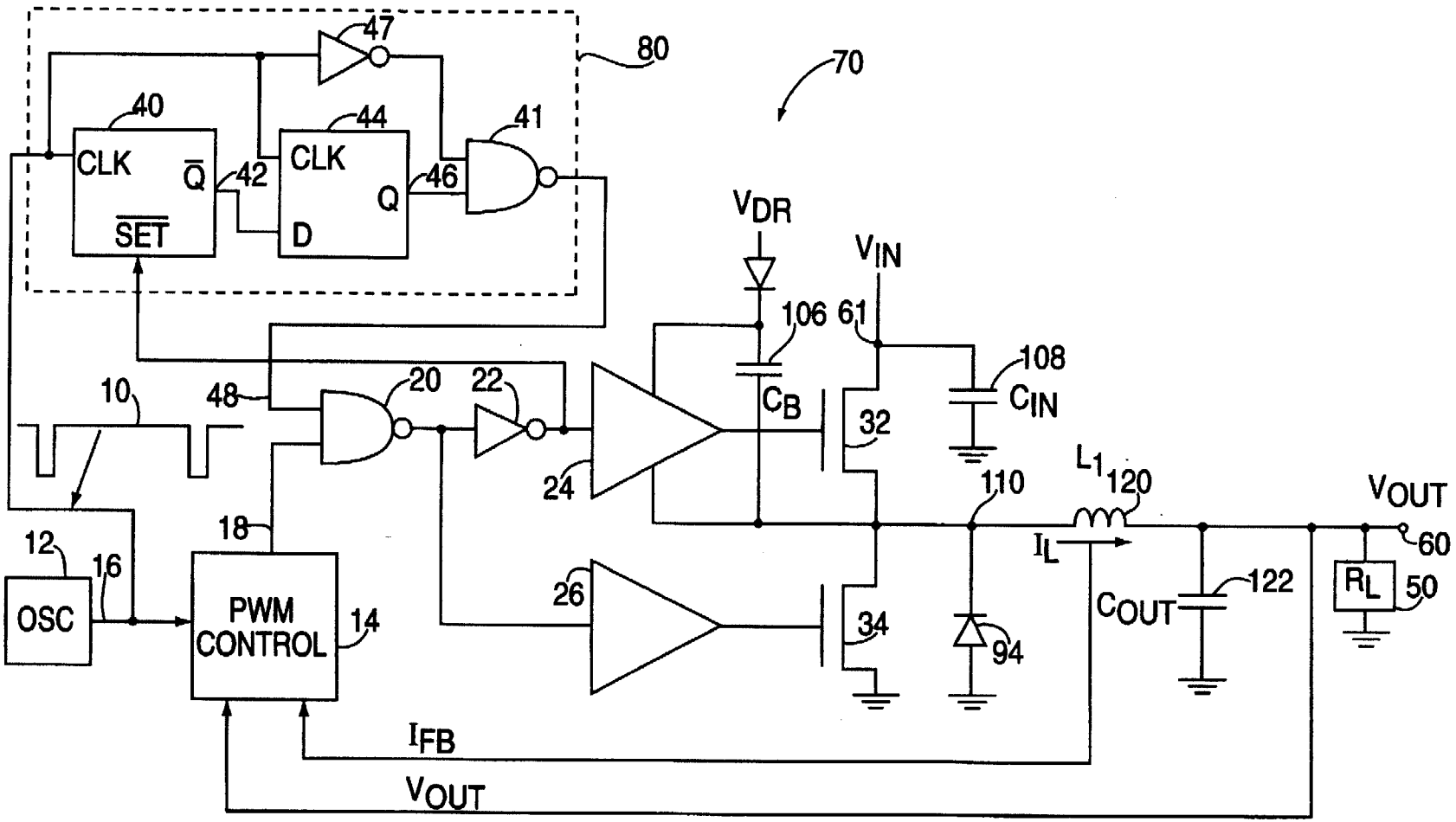
FIG. 2 is a circuit diagram showing an illustrative embodiment of a step-down switching regulator constructed in accordance with the principles of the present invention.

FIG. 2 is a schematic block diagram that incorporates a preferred embodiment of the present invention for providing low drop-out operation of a step-down switching regulator. The switching regulator circuits of the present invention overcome the disadvantages of known switch regulators by including a limiting circuit 80 that allows PWM control circuit 14 to have more complete control over switching transistors 32 and 34.

While the circuits shown in FIGS. 1–4 operate with an n-channel MOSFET for switching transistors 32 and 34, persons skilled in the art will appreciate that such a configuration is merely a design choice and that the principles of the present invention may be equally carried out with NPN bipolar transistors and only minor changes to the remaining circuitry.

The drop-out operation of the circuit of FIG. 2 differs from that of the circuit of FIG. 1 in that oscillator pulse 10 is not allowed to force switching transistor 32 to turn OFF every cycle. Each time switching transistor 32 is turned OFF, a counter 40 is set, which causes the inverted Q output 42 of counter 40 to be a logic low. The signal 42 is clocked from the D input of flip-flop 44 to flip-flop 44's Q output 46, which results in a logic high at input 48 of NAND gate 20. This allows PWM control circuit 14 to turn switching transistor 32 ON continuously for more than one cycle of the oscillator output signal 16. This in turn allows higher duty cycles and lower drop-out operation than if switching transistor 32 were forced to turn OFF once every cycle during drop-out by oscillator pulse 10.

Once counter 40 is set, counter 40 monitors the number of cycles of oscillator 12 during which switching transistor 32 is turned ON. On the Nth count, inverted Q output 42 of counter 40 changes from low to high. On the N+1 count, the high signal is clocked from the D input of flip-flop 44 to Q output 46 of flip-flop 44. At the same time oscillator output signal 16 is inverted by inverter 47 (i.e., the output of inverter 47 is low), so that the signal at input 48 remains high until the N+2 oscillator pulse 10. At that time oscillator pulse 10, which is now low, is passed through NAND gate 20 and inverter 22, causing switching transistor 32 to turn OFF and switching transistor 34 to turn ON for the duration of oscillator pulse 10. At the same time, counter 40 is again set, causing inverted Q output 42 to go low. On the subsequent oscillator pulse 10, this low output signal is again clocked to Q output 46 of D flip-flop 44, resulting in a high at input 48. This high signal at input 48 again allows switch transistor 32 to remain ON and switching transistor 34 to remain OFF.

Thus, the regulator is maintained in drop-out by control signal 18 being continuously high, so that switching transistor 32 is only turned OFF once every N+2 cycles of oscillator 12. N may be adjusted to extend the maximum duty cycle while still preventing audible operation in drop-out.

Figure 3:
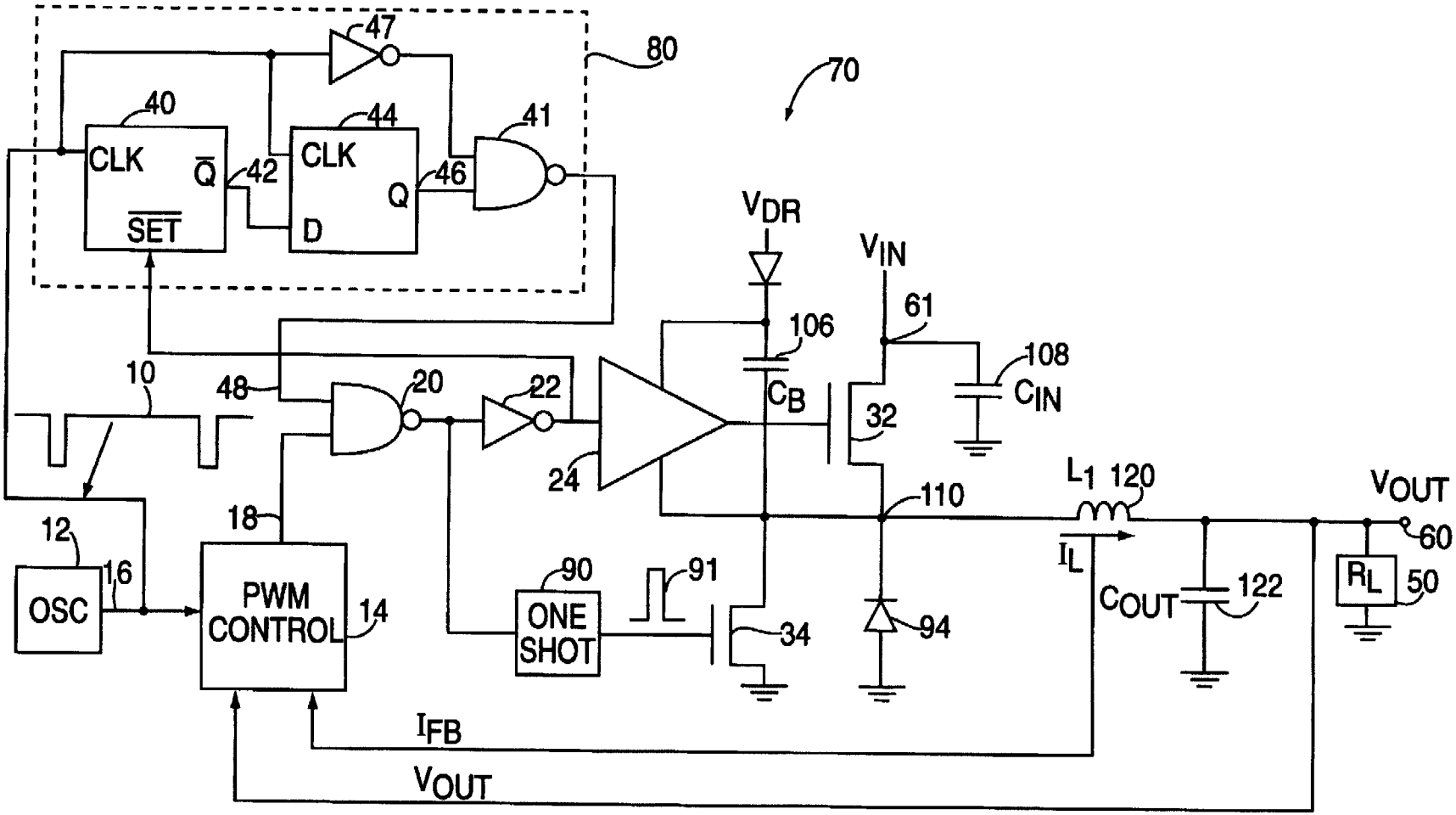
FIG. 3 is a circuit diagram showing an illustrative embodiment of a non-synchronous step-down switching regulator constructed in accordance with the principles of the present invention.

FIG. 3 is a schematic block diagram that incorporates another preferred embodiment of the present invention for providing low drop-out operation of a non-synchronous step-down switching regulator.

The non-synchronous step-down switching regulator circuit of FIG. 3 is similar to the switching regulator circuit of FIG. 2, except that driver 26 is replaced by one-shot circuit 90. Unlike switching transistor 34 of the step-down switching regulators of FIGS. 1 and 2, switching transistor 34 of FIG. 3 turns ON only for a brief time after switching transistor 32 turns OFF. Turning switching transistor 34 ON pulls the lower plate of boot-strap capacitor 106 ($C_B$) close to ground thereby ensuring that boot-strap capacitor 106 ($C_B$) is able to recharge and provide the necessary operating voltage for driver 24. Because switching transistor B4 is ON only for the time required to recharge boot-strap capacitor 106 ($C_B$), it can be smaller than switching transistor 32.

Figure 4:
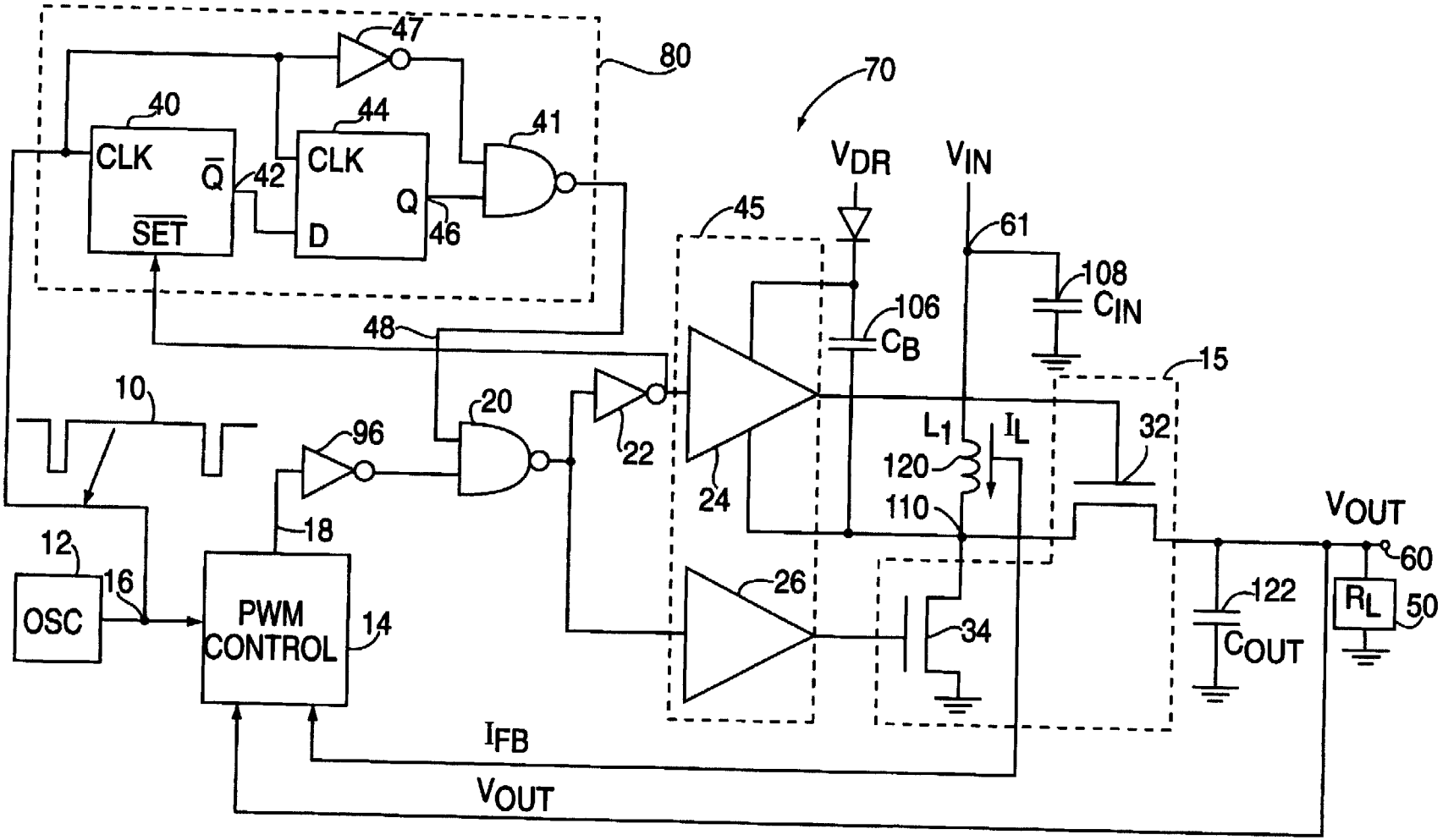
FIG. 4 is a circuit diagram showing an illustrative embodiment of a synchronous boost switching regulator constructed in accordance with the principles of the present invention.

FIG. 4 is a schematic block diagram that incorporates still another preferred embodiment of the present invention for providing low drop-out operation of a synchronous boost switching regulator.

Driver circuit 45 is used to drive switch circuit 15, which is a push-pull switch including a pair of synchronously-switched switching transistors 32 and 34. Switching transistor 34 is coupled between switch node 110 and ground. Switching transistor 32 is coupled between switch node 110 and output terminal 60.

Switching transistors 32 and 34 are used to provide an switching supply of current to an output circuit that includes inductor 120 ($L_1$) coupled between input terminal 61 and switch node 110, and output capacitor 122 ($C_{OUT}$) coupled between output terminal 60 and ground. The output circuit couples the peaks of the switch node 110 waveform to output terminal 60 so that load 50 is provided a regulated voltage $V_{OUT}$. In order to supply inductor 120 current, switching transistors 32 and 34 are respectively driven by driver 24 and driver 26, which in turn are both controlled by a pulse-width modulator ("PWM") control circuit 14.

Driver 24 is controlled by the output of inverter 22, whose input is the output of NAND gate 20. The output of NAND gate 20 is produced based upon signal 16 from oscillator 12 and control signal 18 from the output of PWM control circuit 14. Driver 26 is controlled directly by the output signal of NAND gate 20. PWM control circuit 14 uses a signal from oscillator 12, the output voltage $V_{OUT}$ and a feedback current $I_{FB}$, that is proportional to inductor current $I_L$, to generate control signal 18.

During drop-out operation of the synchronous boost switching regulator of FIG. 4, limiting circuit 80 prevents oscillator pulse 10 from forcing switching transistor 32 OFF and switching transistor 34 ON every cycle. Each time switching transistor 32 is turned OFF, a counter 40 is set, which causes inverted Q output 42 of counter 40 to be a logic low. The signal 42 (i.e., now a logic low) is clocked from the D input of flip-flop 44 to flip-flop 44's Q output 46, which results in a logic high at input 48 of NAND gate 20. This allows PWM control circuit 14 to turn driver 26 OFF and allows switching transistor 32 to remain ON and switching transistor 34 to remain OFF continuously for more than one cycle of oscillator output signal 16. This in turn allows lower duty cycles and lower drop-out operation than if switching transistor 32 were forced to turn OFF and switching transistor 34 were forced to turn ON once every cycle during drop-out by oscillator pulse 10.

Once counter 40 is set, counter 40 monitors the number of cycles of oscillator 12 during which switching transistor 32 is turned ON. On the Nth count, inverted Q output 42 of counter 40 changes from low to high. On the N+1 count, the high signal is clocked from the D input of flip-flop 44 to Q output 46 of flip-flop 44. At the same time oscillator output signal 16 is inverted by inverter 47 (i.e., the output of inverter 47 is low), so that the signal at input 48 remains high until the N+2 oscillator pulse 10. At that time oscillator pulse 10, which is now low, is passed through NAND gate 20 and inverter 22, causing switching transistor 32 to turn OFF and switching transistor 34 to turn ON for the duration of oscillator pulse 10. At the same time, counter 40 is again set, causing inverted Q output 42 to go low. On the subsequent oscillator pulse 10, this low output signal is again clocked to Q output 46 of D flip-flop 44, resulting in a high at input 48. This high signal at input 48 again allows switch transistor 32 to remain ON and switching transistor 34 to remain OFF.

Thus, the synchronous boost regulator of FIG. 4 is maintained in drop-out by control signal 18 being continuously low, so that switching transistor 34 is only turned ON once every N+2 cycles of oscillator 12.

Step-down/boost switching regulators having high/low duty cycles during drop-out operation are provided.

Although three particular illustrative embodiments have been disclosed, persons skilled in the art will appreciate that the present invention can be practiced by other than the disclosed embodiments, which are presented for purposes of illustration, and not of limitation, and the present invention is limited only by the claims that follow.

What is claimed is:

1. A switching voltage regulator circuit comprising:

a switch circuit coupled to a source of input voltage, said switch circuit comprising a first switching element coupled to a switch node;

a driver circuit comprising a first driver coupled to said first switching element;

an output circuit coupled to said switch circuit, said output circuit comprising an inductive storage element and a capacitive storage element coupled between an output terminal and ground;

a control circuit that generates a control signal based at least in part on an oscillator signal from an oscillator circuit, said control circuit being coupled to said driver circuit to provide said control signal to said driver circuit; and a limiting circuit coupled to said control circuit to change the state of said control signal when said first switching element has been in a continuous conductive state for a predetermined number of oscillator cycles.

2. The switching voltage regulator circuit of claim 1, further comprising a second switching element coupled between said switch node and ground.

3. The switching voltage regulator circuit of claim 2, wherein said driver circuit further comprises a second driver coupled to said second switching element.

4. The switching voltage regulator circuit of claim 3, wherein said control circuit comprises:

a pulse-width modulator controller that generates an output based at least in part on a feedback signal that corresponds to current flowing in said inductive storage element and a feedback signal that corresponds to voltage at said output terminal.

5. The switching voltage regulator circuit of claim 1, further comprising a second capacitive storage element coupled between a source of drive voltage and said switch node.

6. The switching voltage regulator circuit of claim 1 wherein said limiting circuit comprises:

a counter having a clock input driven by said oscillator signal, a reset input and an output that changes state when said counter has counted a predetermined number of oscillator cycles, said counter being reset each time said first switching element is turned OFF; and a logic circuit coupled to said counter and said control circuit, said logic circuit changing the state of said control signal as a result of said output of said counter changing state.

7. The switching voltage regulator circuit of claim 6, wherein said logic circuit comprises:

a flip-flop having a clock input driven by said oscillator signal and a signal input coupled to said output of said counter, said flip-flop having an output that changes from low to high when a high signal is at said signal input and said clock input is driven high by said oscillator signal;

a first limiting circuit logic gate that inverts said oscillator signal; and a second limiting circuit logic gate having a first input coupled to said first gate and a second input coupled to said output of said flip-flop, said second gate producing an output signal that changes state when said first switching element has been in a continuous conductive state for a predetermined number of oscillator cycles.

8. The switching voltage regulator circuit of claim 1 wherein said first switching element is a MOSFET.

9. The switching voltage regulator circuit of claim 1, wherein said first switching element is coupled between said source of input voltage and said switch node.

10. The switching voltage regulator circuit of claim 1, wherein said inductive storage element is coupled between said switch node and said output terminal.

11. The switching voltage regulator circuit of claim 4, wherein said control circuit further comprises:

a first control circuit logic gate with a first input coupled to said limiting circuit and a second input coupled to said output of said pulse-width modulator controller, said first control circuit logic gate producing a first control circuit logic gate signal; and a second control circuit logic gate coupled to said first control circuit logic gate, said second control circuit logic gate for inverting said first control circuit logic gate signal.

12. The switching voltage regulator circuit of claim 11, wherein said first driver comprises an input coupled to said second control circuit logic gate.

13. The switching voltage regulator circuit of claim 12, wherein said second driver comprises an input coupled to said first control circuit logic gate.

14. The switching voltage regulator circuit of claim 11, wherein said limiting circuit comprises:

a counter having a clock input driven by said oscillator signal, a reset input and an output that changes state when said counter has counted a predetermined number of oscillator cycles, said counter being reset each time said first switching element is turned OFF; and a logic circuit coupled to said counter and said control circuit, said logic circuit changing the state of said control signal as a result of said output of said counter changing state.

15. The switching voltage regulator circuit of claim 14, wherein said logic circuit comprises:

a flip-flop having a clock input driven by said oscillator signal and a signal input coupled to said output of said counter, said flip-flop having an output that changes from low to high when a high signal is at said signal input and said clock input is driven high by said oscillator signal;

a first limiting circuit logic gate that inverts said oscillator signal; and a second limiting circuit logic gate having a first input coupled to said first gate and a second input coupled to said output of said flip-flop, said second gate producing an output signal that changes state when said first switching element has been in a continuous conductive state for a predetermined number of oscillator cycles.

16. The switching voltage regulator circuit of claim 3, wherein said second driver comprises a one-shot circuit.

17. The switching voltage regulator circuit of claim 1, further comprising a conducting element coupled between said switch node and ground, said conducting element conducting when said first switching element is OFF.

18. The switching voltage regulator circuit of claim 1, wherein said first switching element is coupled between said switch node and said output terminal.

19. The switching voltage regulator circuit of claim 1, wherein said inductive storage element is coupled between said source of input voltage and said switch node.

20. The switching voltage regulator circuit of claim 4, wherein said control circuit further comprises:

a first control circuit logic gate with an input coupled to said output of said pulse-width modulator controller for inverting said output of said pulse-width modulator controller;

a second control circuit logic gate with a first input coupled to said limiting circuit and a second input coupled to said first control circuit logic gate, said second control circuit logic gate producing a second control logic gate signal; and a third control circuit logic gate coupled to said second control circuit logic gate, said third control circuit logic gate for inverting said second control circuit logic gate signal.

21. The switching voltage regulator circuit of claim 20, wherein said first driver comprises an input coupled to said output of said third control circuit logic gate.

22. The switching voltage regulator circuit of claim 20, wherein said second driver comprises an input coupled to said output of said second control circuit logic gate.

23. The switching voltage regulator circuit of claim 20, wherein said limiting circuit comprises:

a counter having a clock input driven by said oscillator signal, a reset input driven by said output of said third control circuit logic gate and an output that changes state when said counter has counted a predetermined number of oscillator cycles, said counter being reset each time said first switching element is turned OFF; and a logic circuit coupled to said counter and said control circuit, said logic circuit changing the state of said control signal as a result of a said counter output changing state.

24. The switching voltage regulator circuit of claim 23, wherein said logic circuit comprises:

a flip-flop having a clock input driven by said oscillator signal, and a signal input coupled to said output of said counter, said flip-flop having an output that changes from low to high when a high signal is at said signal input and said clock input is driven high by said oscillator signal;

a first limiting circuit logic gate that inverts said oscillator signal; and a second limiting circuit logic gate having a first input coupled to said first gate and a second input coupled to said output of said flip-flop, said second gate producing an output signal that changes state when said first switching element has been in a continuous conductive state for a predetermined number of oscillator cycles.

25. A method for controlling a switching voltage regulator comprising the steps of:

producing a first control signal based at least in part on an oscillator signal;

applying said first control signal to a driver circuit, said driver circuit comprising a first driver that produces a first driver signal;

driving with said first driver signal a switch circuit coupled to a source of input voltage, said switch circuit comprising a first switching element coupled to a switch node;

providing a switch signal from said switch circuit to an output circuit that produces a regulated output signal;

monitoring said regulated output signal;

modifying said first control signal based at least in part on said regulated output signal; and combining said control signal with a limiting signal that allows said first switching element to be in a continuous conductive state for a predetermined number of oscillator cycles.

26. The method of claim 25, wherein:

said driver circuit further comprises a second driver;

said switch circuit further comprises a second switching element coupled between said switch node and ground and driven by said second driver; and said first switching element is coupled between said source of input voltage and said switch node.

27. The method of claim 25, wherein:

said driver circuit further comprises a second driver that comprises a one-shot circuit;

said switch circuit further comprises a second switching element coupled between said switch node and ground and driven by said second driver; and said first switching element is coupled between said source of input voltage and said switch node.

28. The method of claim 25, wherein:

said driver circuit further comprises a second driver;

said switch circuit further comprises a second switching element coupled between said switch node and ground and driven by said second driver; and said first switching element is coupled between said switch node and said output terminal.

* * * * *